US008453542B2

(12) United States Patent
Gouws

(10) Patent No.: US 8,453,542 B2
(45) Date of Patent: Jun. 4, 2013

(54) WRENCH FOR USE WITH DRILLING APPARATUS

(76) Inventor: Petrus Christiaan Gouws, Witbank (ZA)

( * ) Notice: Subject to any disclaimer, the term of this patent is extended or adjusted under 35 U.S.C. 154(b) by 341 days.

(21) Appl. No.: 12/675,648

(22) PCT Filed: Aug. 27, 2008

(86) PCT No.: PCT/IB2008/053446

§ 371 (c)(1),
(2), (4) Date: Feb. 26, 2010

(87) PCT Pub. No.: WO2009/027934

PCT Pub. Date: Mar. 5, 2009

(65) Prior Publication Data

US 2011/0146457 A1 Jun. 23, 2011

(30) Foreign Application Priority Data

Aug. 28, 2007 (ZA) ..... 2007-07284

(51) Int. Cl.
*B25B 13/50* (2006.01)

(52) U.S. Cl.
USPC ..... 81/57.2; 81/57.34; 81/57.19

(58) Field of Classification Search
USPC ..... 81/57.2, 57.18, 57.19, 57.34, 57.33, 81/57.35, 57.16, 57.24
See application file for complete search history.

(56) References Cited

U.S. PATENT DOCUMENTS

| | | | | |
|---|---|---|---|---|
| 2,760,392 | A | 8/1956 | Paget | |
| 4,194,419 | A | 3/1980 | Mitchhart et al. | |
| 5,653,297 | A | 8/1997 | Whisenhunt | |
| 5,785,132 | A * | 7/1998 | Richardson et al. | 81/57.34 |
| 5,791,206 | A | 8/1998 | Daigle et al. | |
| 5,996,444 | A * | 12/1999 | Pearce et al. | 81/57.19 |
| 6,012,360 | A | 1/2000 | Concha | |
| 2003/0131689 | A1 | 7/2003 | Gouws | |
| 2011/0138969 | A1 * | 6/2011 | Gouws | 81/57.33 |

FOREIGN PATENT DOCUMENTS

| | | |
|---|---|---|
| WO | WO-99/22915 A2 | 5/1999 |

OTHER PUBLICATIONS

International Search Report, International Application No. PCT/IB2008/053446, mailed Jul. 14, 2009.

Written Opinion of the International Searching Authority, International Application No. PCT/IB2008/053446, mailed Jul. 14, 2009.

* cited by examiner

*Primary Examiner* — Hadi Shakeri

(74) *Attorney, Agent, or Firm* — Nixon Peabody LLP; Jeffrey L. Costellia

(57) ABSTRACT

The invention relates to a wrench for use with drilling apparatus and which serves for loosening adjacent drill bit segments of a drill bit during drilling of extended holes into the ground and where this involves the insertion of, or the removal of, extension segments from the drill bit. The wrench includes a pair of carrier members whereby it is supported on the support structure of a drilling apparatus, as well as a pair of gripping members, displaceably supported between the carrier members and between which a drill bit segment can be gripped, and piston/cylinder mechanisms whereby the carrier members, and hence the wrench, can be displaced between an inoperative stowed configuration and an operative configuration and whereby the gripping members can be displaced for gripping a drill bit segment and for loosening the segment with respect to an adjacent segment.

4 Claims, 12 Drawing Sheets

WRENCH FOR USE WITH DRILLING APPARATUS

FIELD OF INVENTION

This invention relates to a wrench for use with drilling apparatus.

BACKGROUND TO THE INVENTION

The invention relates particularly to a wrench for use with drilling apparatus used for drilling holes into the ground with a drill rod comprising a drilling segment, extension segments and a distance piece, the distance piece, in use, being engaged by the drilling apparatus, thereby to connect the drill rod to the drilling apparatus. The above segments of a drill rod are hereinafter referred to merely as drill rod segments.

As part of a drilling operation, extension segments of a drill rod must be located in line with or removed from the drill rod, which requires adjacent segments of the drill rod, connected via complementary threads in a spigot and socket fashion, to be loosened with respect to one another. Insofar as the thread configuration of drill rod segments of a drill rod provide for segments to be tightened together during drilling, a wrench, referred to herein as a drill rod wrench, that is operatively mounted on the support structure of a drilling apparatus, is provided for loosening adjacent segments, many different configuration drill rod wrenches being already well known. Each of these drill rod wrenches provides essentially for a drill rod segment to be gripped between opposing jaws and for the wrench to be displaced around the drill rod gripped, for loosening thereof.

A particular drill rod wrench that forms the subject matter of the Applicant's U.S. Pat. No. 6,817,271 comprises a gripping arm, that defines a mouth formation locatable around a drill rod segment and that has gripping formations located thereon, and a lever arm, that defines a wedge face and that is pivotally connected to the gripping arm, particularly in a configuration in which initial pivotal displacement of the lever arm with respect to the gripping arm provides for the wedge face defined thereby to act on the drill rod segment to be gripped for urging the drill rod segment into gripping engagement with oppositely located gripping formations of the gripping arm. Continued displacement of the lever arm then provides for loosening of the drill rod segment relative to an adjacent segment, the force applied by the wedge face on the drill rod segment for urging into gripping engagement with the gripping formations, due to its relative displacement with respect to the drill rod segment, increasing until loosening of the drill rod segment occurs. The displacement of the lever arm is induced by a piston/cylinder mechanism acting between the lever arm and the support structure of the drilling apparatus, the exact configuration of the wrench being clearly apparent from the disclosure of the Applicant's abovementioned patent, It has become apparent that the drill rod wrench forming the subject matter of the Applicant's abovementioned patent is very effective in relation to the required loosening of adjacent drill rod segments, but insofar as the general configuration of different drilling apparatus requires a wrench to operate within different space parameters, the wrench as originally envisaged and as covered in the above patent cannot be employed in association with all drilling apparatus. As such, it is an object of this invention to provide an alternative configuration drill rod wrench which can operate in a relatively more restricted space, while still utilising the gripping arrangement, including a gripping arm and a lever arm as above envisaged, for gripping a drill rod segment.

SUMMARY OF THE INVENTION

According to the invention there is provided a drill rod wrench for use on a drilling apparatus for loosening a drill rod segment of a drill rod, having a diameter falling within a predetermined diameter range, with respect to an adjacent drill rod segment of the drill rod, which includes, in its operative configuration with respect to a drilling apparatus having a support structure supporting the apparatus in a location where drilling is required, a pair of carrier members that are pivotally supported on the support structure of the drilling apparatus in a configuration in which the wrench is displaceable between an inoperative stowed-away configuration when drilling is permitted and an operative configuration in which the wrench is operable for loosening a drill rod segment;

a pair of engaged gripping members that are supported between the pair of carrier members and that, in combination, define an open mouth formation within which a drill rod segment, of a drill rod of the drilling apparatus, to be loosened with respect to an adjacent drill rod segment, is received when the carrier members are displaced into their operative configuration, the gripping members being displaceable between a first configuration in which the drill rod is freely received within the mouth formation and a second configuration in which it is snugly received within the mouth formation, one gripping member having a lever arm, that defines a convex wedge formation, pivotally located thereon with pivotal displacement of the lever arm providing for displacement of the convex wedge formation with respect to the drill rod segment received within the mouth formation in a configuration in which, by a wedging action on the drill rod segment urges the drill rod segment into gripping engagement with gripping formations located on the other gripping member in a substantially diametrically opposite location with respect to the drill rod segment to the location where the convex wedge formation acts on the drill rod segment, the gripping members as a combination being displaceably located between the pair of carrier members in a configuration in which they are displaceable for rotation about the axis defined by a drill rod segment gripped between them; and displacement mechanisms providing respectively for the displacement of the pair of carrier members between their inoperative configuration and their operative configuration, displacement of the gripping members with respect to one another between their first configuration and their second configuration, pivotal displacement of the lever arm and displacement of the gripping members in combination about the axis of a drill rod segment gripped between them.

The displacement mechanism for displacing the pair of carrier members between their inoperative configuration and their operative configuration may include at least one first piston/cylinder mechanism that is operatively connected between the support structure of the drilling apparatus on which the carrier members are pivotally supported and one of the carrier members and that is hydraulically operable for displacing the carrier members between their inoperative and operative configurations.

The gripping members of the pair of engaged gripping members may be engaged by pin formations provided on one gripping member that are slideably located within slot formations defined in the other gripping member, in a configuration which they are linearly displaceable with respect to one another for permitting the displacement between their first and second configurations. The displacement mechanism for displacing the gripping members with respect to one another may be a second piston/cylinder mechanism operatively connected between the gripping members and that is hydraulically operable for displacing the gripping members between their first configuration and their second configuration.

Still further, the gripping members of the pair of engaged gripping members, in combination, may be displaceably located between the pair of carrier members via pin formations engaged with an arcuate slot defined within the respective carrier members, a displacement mechanism in the form of a third piston/cylinder mechanism being operatively connected between the pair of carrier members and the pair of gripping members in a configuration in which it is hydraulically operable for displacing the pair of gripping members rotatably about the axis defined by a drill rod segment received within the open mouth formation defined by the gripping members, the arcuate slots within which the pair of gripping members are engaged via the pin formations accommodating the required rotational displacement of the pair of gripping members. The said third piston/cylinder mechanism particularly is operatively connected between the pair of carrier members and the gripping member that has a lever arm pivotally located thereon, the third piston/cylinder mechanism being connected to the lever arm in a location in which it can serve also to provide for the required pivotal displacement of the lever arm that provides for gripping of a drill rod segment by being urged into gripping engagement with the gripping formations located on the said other gripping member.

The configuration of the third piston/cylinder mechanism between the pair of carrier members and the lever arm particularly is such that by operation of this third piston/cylinder mechanism it provides firstly for the required pivotal displacement of the lever arm in order to provide for effective gripping of the drill rod segment and then for the required rotational displacement of the pair of gripping members to provide for loosening of the drill rod segment gripped with respect to an adjacent drill rod segment, the gripping force induced by the lever arm increasing as the wedging action on the convex wedge formation defined by the lever arm continues, which will occur until loosening of adjacent drill rod segments occur.

It must be appreciated that the exact construction of the drill rod wrench of the invention as well as the mode of operation thereof are greatly variable, the invention extending to all such alternative configuration drill rod wrenches that still incorporate the constructional and operational principles of the drill rod wrench of the invention as herein above defined.

It must be appreciated also that the overall operation of the drill rod wrench of the invention can be remotely controlled via suitable control means that can control the operation of the displacement mechanisms, particularly in a required sequence to provide for loosening of drill rod segments with respect to one another as required. The invention extends also to a drill rod wrench that includes such control means as part thereof.

BRIEF DESCRIPTION OF THE DRAWINGS

Further features of the drill rod wrench of the invention and the mode of operation thereof are described in more detail hereinafter with reference to an example of such a drill rod wrench, which is illustrated in the accompanying diagrammatic drawings. In the drawings.

DETAILED DESCRIPTION OF THE DRAWINGS

Figures 1A, 1B, 1C:
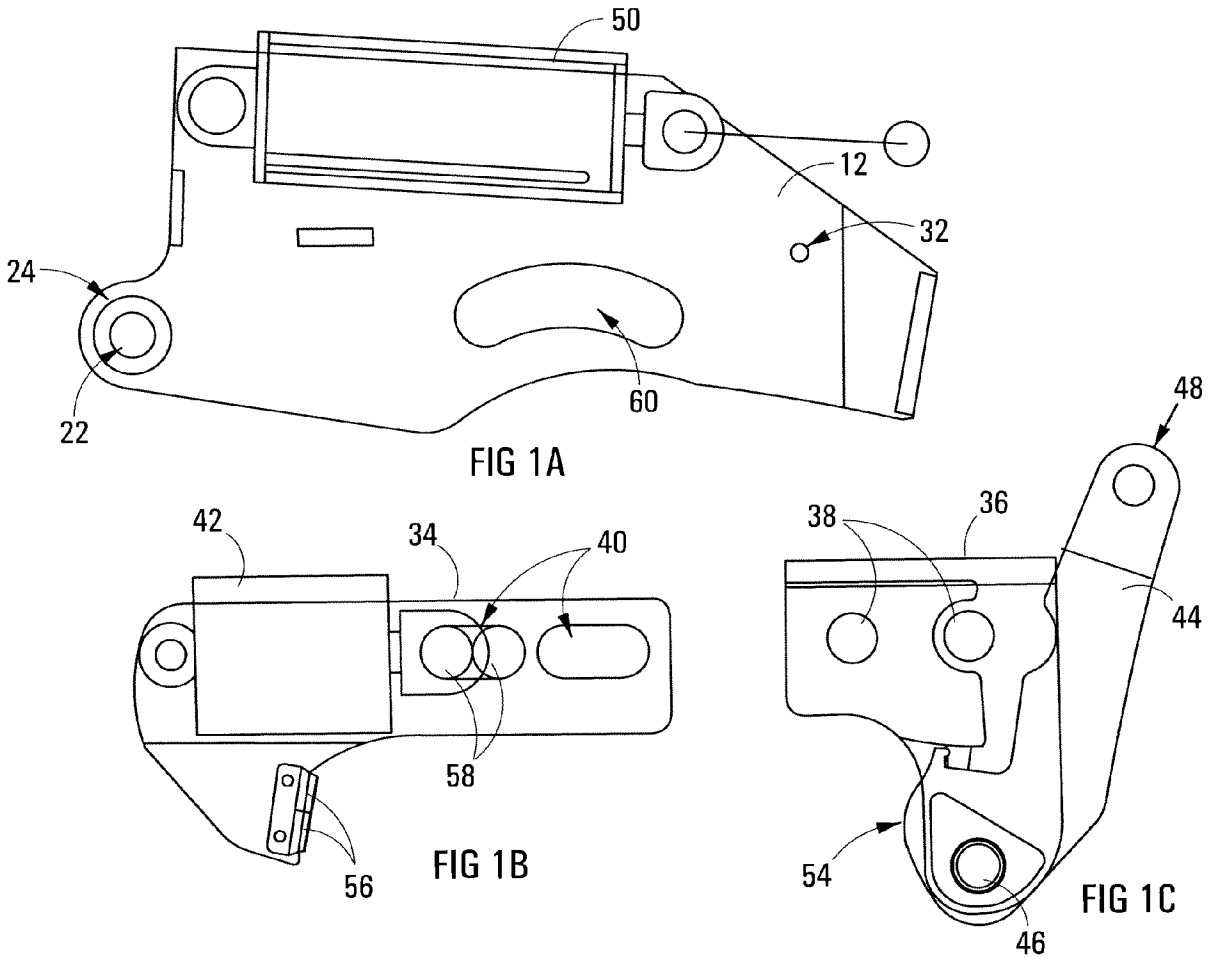
FIGS. 1A, 1B and 1C show an exploded plan view of the main parts of a drill rod wrench, in accordance with the invention.
Figure 2:
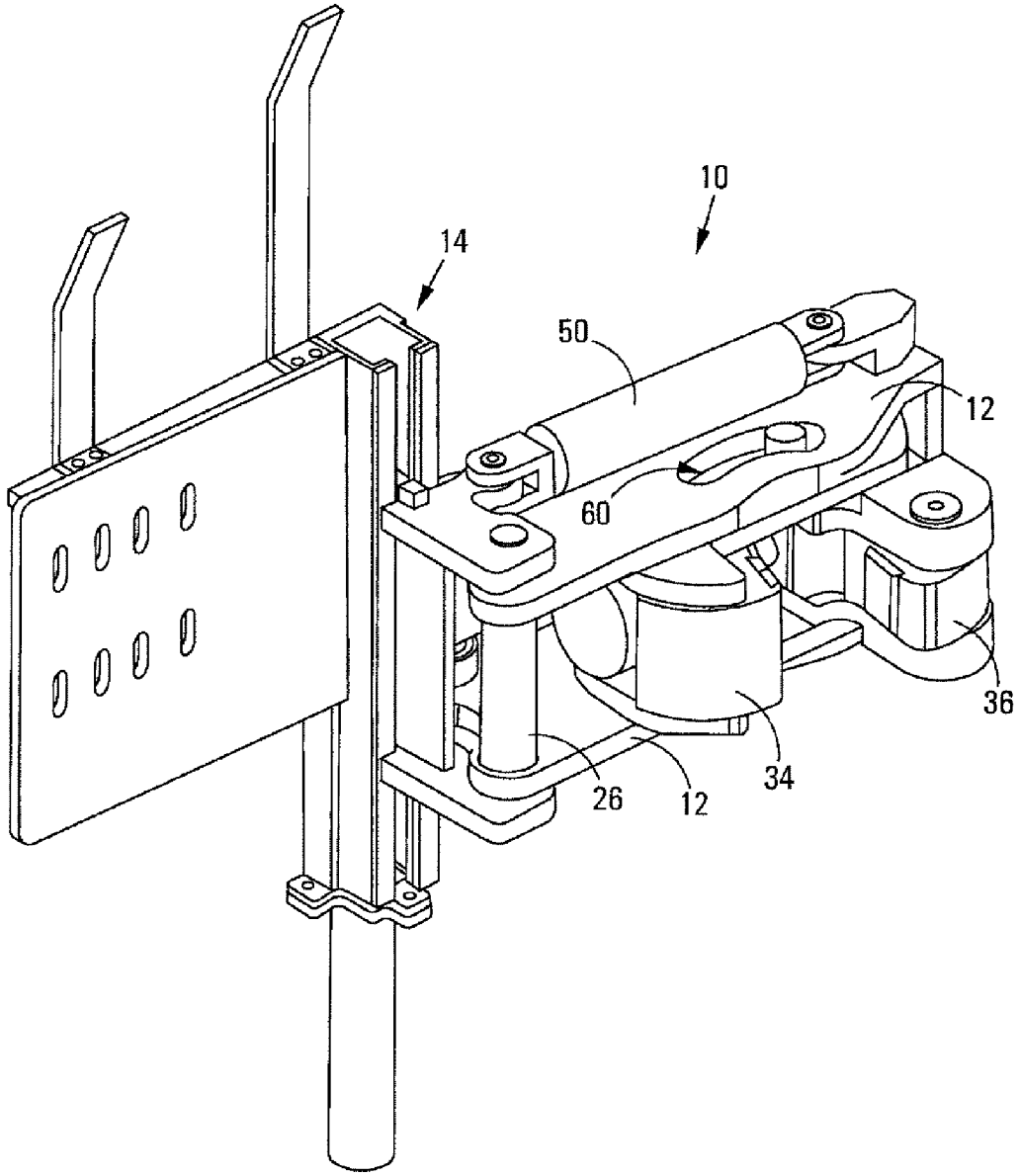
FIG. 2 illustrates in three-dimensional view the general configuration of the drill rod wrench, in accordance with the invention, in its assembled configuration.
Figure 3:
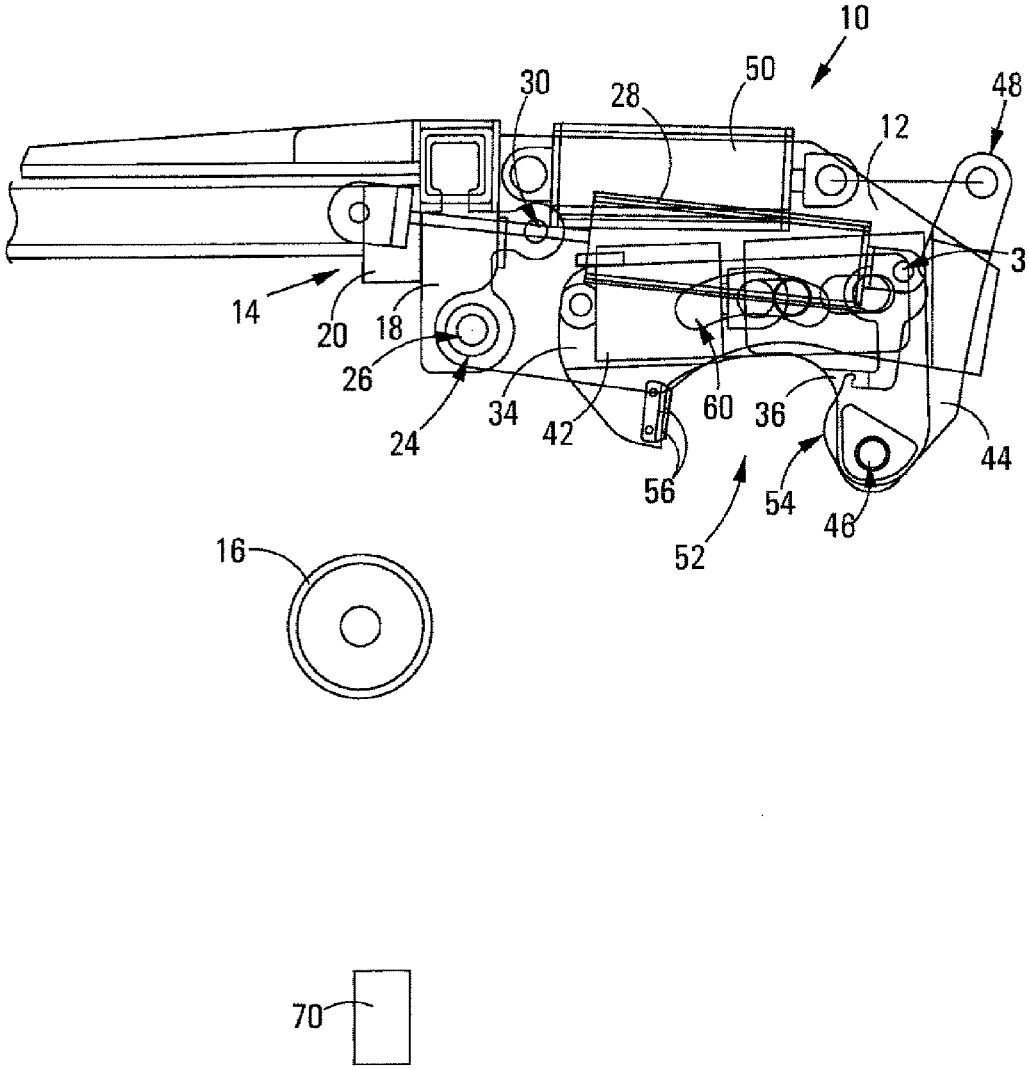
FIG. 3 shows in plan view a drill rod wrench, including the parts as shown in FIGS. 1A, 1B and 1C, in its assembled configuration supported on the support structure of a drilling apparatus and in an inoperative stowed-away configuration thereof.

Referring initially to FIGS. 1, 2 and 3 of the drawings, a complete drill rod wrench, in accordance with the invention and in its assembled operative configuration supported on the support structure of a drilling apparatus, is shown in FIGS. 2 and 3 and is designated generally by the reference numeral 10. The drill rod wrench 10 includes a pair of carrier members 12 that, in their configuration as shown in FIG. 2, is pivotally supported on the support structure of a drilling apparatus, the support structure being only partially shown and being designated generally by the reference numeral 14. The support structure 14 serves to support the drilling part of a drilling apparatus (not shown) used for drilling holes into the ground with a drill rod, which includes a plurality of drill rod segments as herein envisaged, one such drill rod segment 16 being illustrated in its operative configuration, with respect to the support structure 14, in which it can serve to drill a hole into the ground.

Each carrier member 12 of the pair of carrier members (one carrier member being shown in FIG. 1A and the second being a mirror image thereof) is a fabricated plate-like member that has formations formed thereon or applied thereto for serving its purpose as described hereafter. Each carrier member particularly defines an aperture 22 in a projecting segment 24 thereof, the aperture 22 being positioned in register with an aperture defined in a support bracket 18 that projects from a support post 20 of the support structure 14, providing for pivotal engagement of the pair of carrier members 12 with the support bracket 18, particularly via a pivot pin 26 located within the registering apertures. It must be noted that insofar as FIG. 2 illustrates only the general configuration of the assembled drill rod wrench, all the reference numerals associated with the description herein are not identified thereon.

The drill rod wrench 10 includes also two first hydraulically operable piston/cylinder mechanisms 28 (only one shown) that are operatively connected between the support structure 14 and the respective carrier members 12, particularly at the location 30 on the support bracket 18 and locations 32 on the carrier members 12, the piston/cylinder mechanisms 28 being operable for pivotally displacing the pair of carrier member 12 about the pivot axis defined by the pivot pin 26, as is illustrated in the more detail hereafter.

The drill rod wrench 10 includes also a pair of operatively inter-engaged gripping members, 34 and 36 respectively, the gripping member 36 having two engagement pins 38 projecting therefrom that are operatively engaged within complementary slots 40 defined in the gripping member 34, permitting linear displacement of the gripping members with respect with one another along the longitudinal axis defined by the slots 40 and within parameters determined by the length of the slots 40. A second piston/cylinder mechanism 42 is operatively connected between the two gripping members, 34 and 36, this mechanism again being hydraulically operable and providing for required linear displacement of the gripping members with respect to one another, as is again described and explained in more detail hereafter.

The gripping member 36 has a lever arm 44 pivotally located thereon for pivotal displacement about an axis defined by a pivot pin 46, the end 48 of the lever arm 44 and the carrier members 12 having a third piston/cylinder mechanism 50 operatively connected between them, the mechanism 50 being hydraulically operable to provide for pivotal displacement of the lever arm and, as is explained in more detail hereafter, rotational displacement of the two gripping members in combination about a drill rod segment gripped between the gripping members, for loosening thereof.

Figure 4:
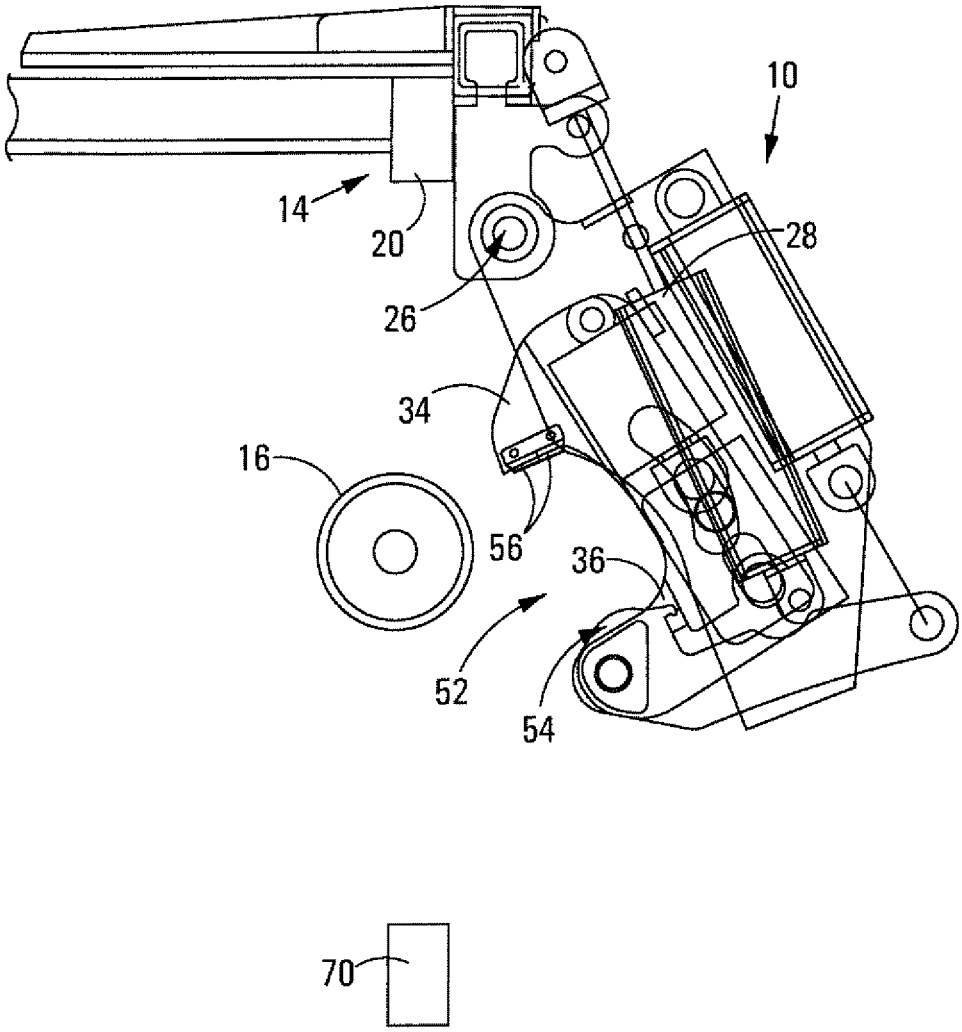
FIGS. 4 to 12 illustrate in plan view the operation of the drill rod wrench as shown in FIG. 2 for loosening adjacent drill rod segments of a drill rod of the drilling apparatus with which the drill rod wrench is operatively associated.

As is illustrated clearly in FIG. 2 of the drawings, the two gripping members, 34 and 36, in combination and when disposed in their operative configuration illustrated, define an open mouth formation 52 between them, the mouth formation 52 being configured to receive a drill rod segment, having a diameter falling within a predetermined diameter range, therein, by the displacement of the drill rod wrench 10 from its inoperative configuration as shown in FIG. 2 into an operative configuration as shown in FIG. 4 and as is explained in more detail hereafter.

The lever arm 44 defines a convex wedge formation 54 that is operatively located within the mouth formation 52 as illustrated, pivotal displacement of the lever arm 44 providing for this convex wedge formation 54 to act on a drill rod segment, received within the mouth formation 52, for urging the drill rod segment by a wedging action into gripping engagement with gripping formations 56 that are located on the gripping member 34, particularly in a substantially diametrically opposite location with respect to the drill rod segment to the location where the wedge formation 54 acts on the drill rod segment. Further explanation in this regard again follows.

The combination of the two gripping members, 34 and 36, in their engaged configuration are supported between the pair of the carrier members 12, particularly via the engagement of locating pins 58, projecting from the gripping member 34, within arcuate slots 60 defined in the respective carrier members 12. The location of the gripping members particularly is such that by the operation of the piston/cylinder mechanism 50, in addition to providing for required displacement of the lever arm 44, rotational displacement of the gripping members, as an engaged combination, is provided for, the gripping members being so displaced about the longitudinal axis of a drill rod segment gripped between the gripping members, thus to induce rotation of the drill rod segment and loosening thereof with respect to an adjacent drill rod segment, as is required by the operation of the drill rod wrench. This is again explained in more detail hereafter.

Figure 5:
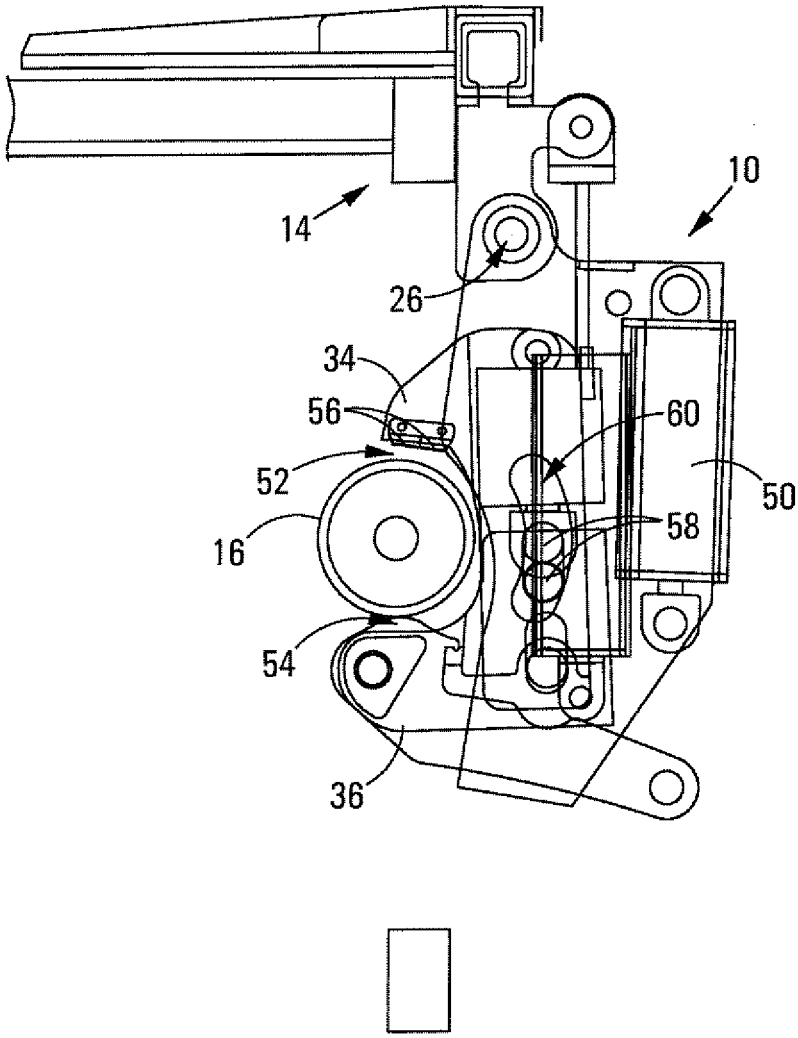
Figure 6:
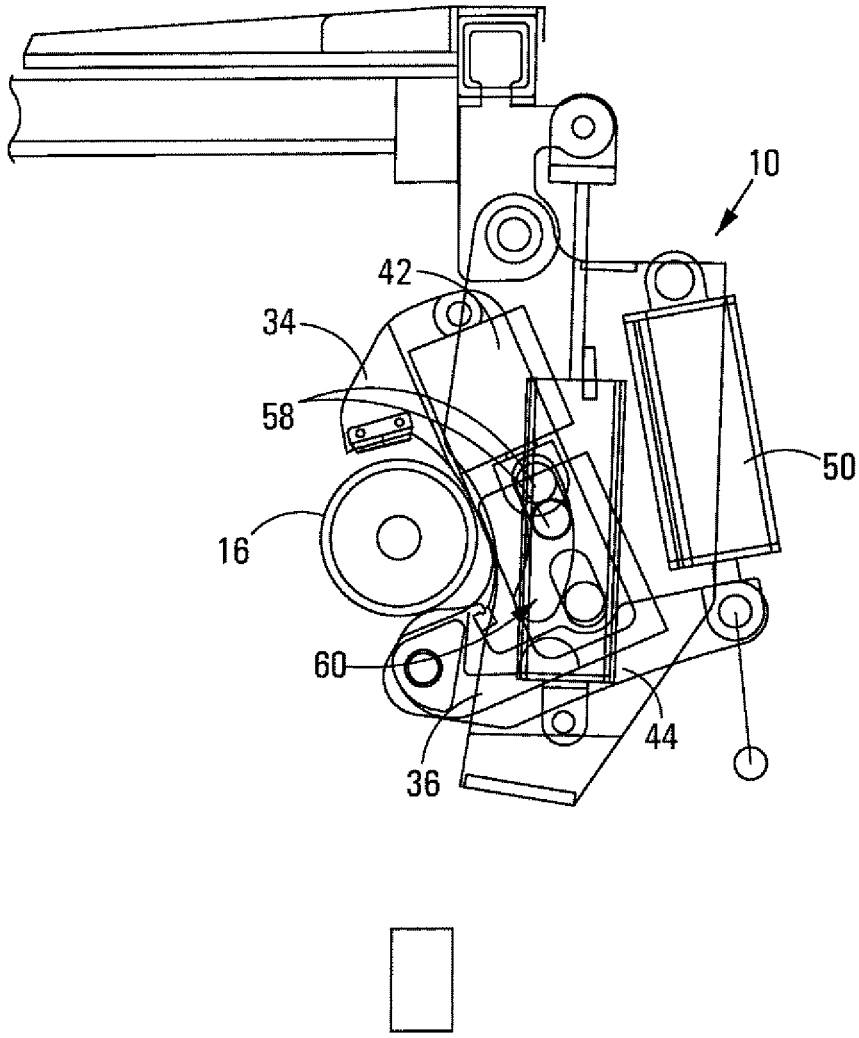

It will be understood that the exact mechanical construction of the drill rod wrench as an entity is not completely illustrated in the drawings, although this will be apparent to anyone skilled in the art. Also, the exact construction of the drill rod wrench is greatly variable while it can still incorporate the features of the drill rod wrench as described and permit operation of the drill rod wrench within the parameters hereinafter described. Referring also to FIGS. 4 to 12 of the drawings, the operation of the drill rod wrench 10, for loosening a drill rod segment 16 of a drill rod with respect to an adjacent drill rod segment, particularly to permit the insertion of an extension segment in line with the drill rod, or the removal of an extension segment there from, is illustrated at sequential stages of the operation, with FIG. 3 illustrating the inoperative, stowed-away configuration of the drill rod wrench. The operation of the drill rod wrench 10 is initiated by the operation of the piston/cylinder mechanisms 28 in order to provide for the pivotal displacement of the pair of carrier members 12 about the pivot axis defined by the pivot pin 26, the carrier members particularly being displaced from their position as shown in FIG. 3, via a position as shown in FIG. 4, into an operative position as shown in FIG. 5. In this position the drill rod segment 16 is received within the open mouth formation 52 defined by the pair of gripping members, 34 and 36, particularly between the convex wedge formation 54 defined by the lever arm 44 of the gripping member 36 and the gripping elements 56 located on the gripping member 34. Insofar as loosening of the drill rod segment 16 requires anti-clockwise rotation of the segment about its axis, the pair of gripping members, 34 and 36, are next rotationally displaced about the axis defined by the drill rod segment 16, particularly by the operation of the piston/cylinder mechanism 50, which effectively acts on the lever arm 44 for displacing the lever arm 44 and, thereby, the gripping members, 34 and 36, from their position as shown in FIG. 5 into the position as shown in FIG. 6. As is clear from FIG. 6, by this rotational displacement of the pair of gripping members, the locating pins 58 are displaced with respect to the pair of carrier members 12 within the arcuate slots 60 defined in the respective carrier members, as is also clearly illustrated in FIG. 6.

Figure 7:
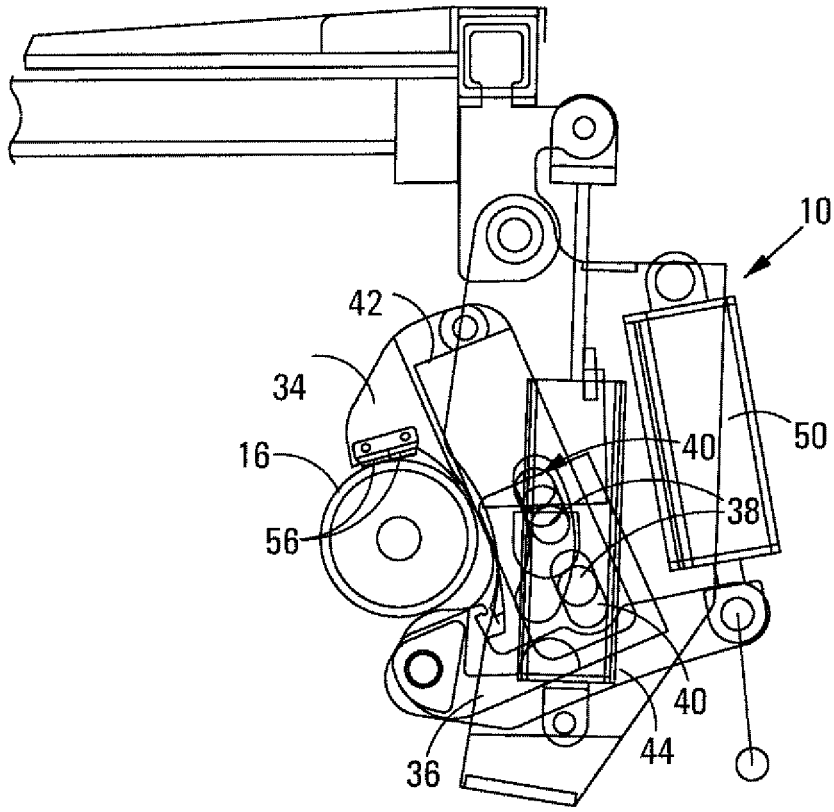

With the pair of gripping members, 34 and 36, disposed in their configuration as shown in FIG. 6 and by the operation of the piston/cylinder mechanism 42, the gripping member 34 is linearly displaced with respect to the gripping member 36, particularly into a position in which the gripping elements 56 are displaced into gripping engagement with the drill rod segment 16, as illustrated in FIG. 7 of the drawings. The relative displacement of the gripping members with respect to one another is clearly apparent also from the displacement of the engagement pins 38 with respect to the slots 40 within which they are engaged.

Figure 8:
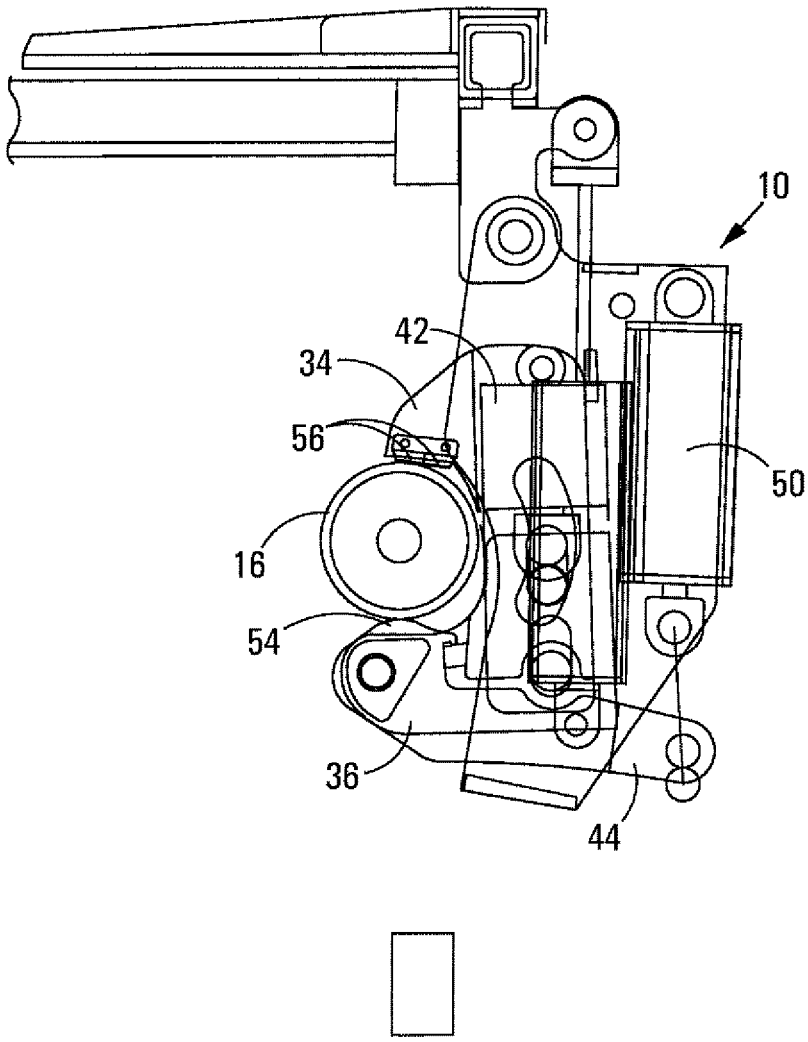

With the piston/cylinder mechanism 42 holding the gripping members, 34 and 36, secure with respect to one another, by the operation of the piston/cylinder mechanism 50 for displacing the lever arm 44 from its position as shown in FIG. 7 to its position as shown in FIG. 8, initially via relative pivotal displacement between the lever arm 44 and the gripping member 36, the convex wedge formation 54 acts on the drill rod segment 16 by a wedging action for urging it into enhanced gripping engagement with the gripping elements 56, the configuration of the convex wedge formation and its location with respect to the drill rod segment 16 when disposed in their configuration as shown in FIG. 7 being such that this wedging action is rendered effective. It will be understood in this regard that the effective contact point between the convex wedge formation and the drill rod segment 16 is substantially, but not exactly, diametrically opposite the location of the gripping elements 56 located on the gripping member 34, the wedging action particularly providing for this contact point to be displaced from a "more" offset location with respect to a directly diametrically opposite location to a "less" offset location, i.e. a location nearer the diametrically opposite location. Insofar as this operation of a lever arm with respect to gripping elements is already known, this is not explained further herein.

Figure 9:
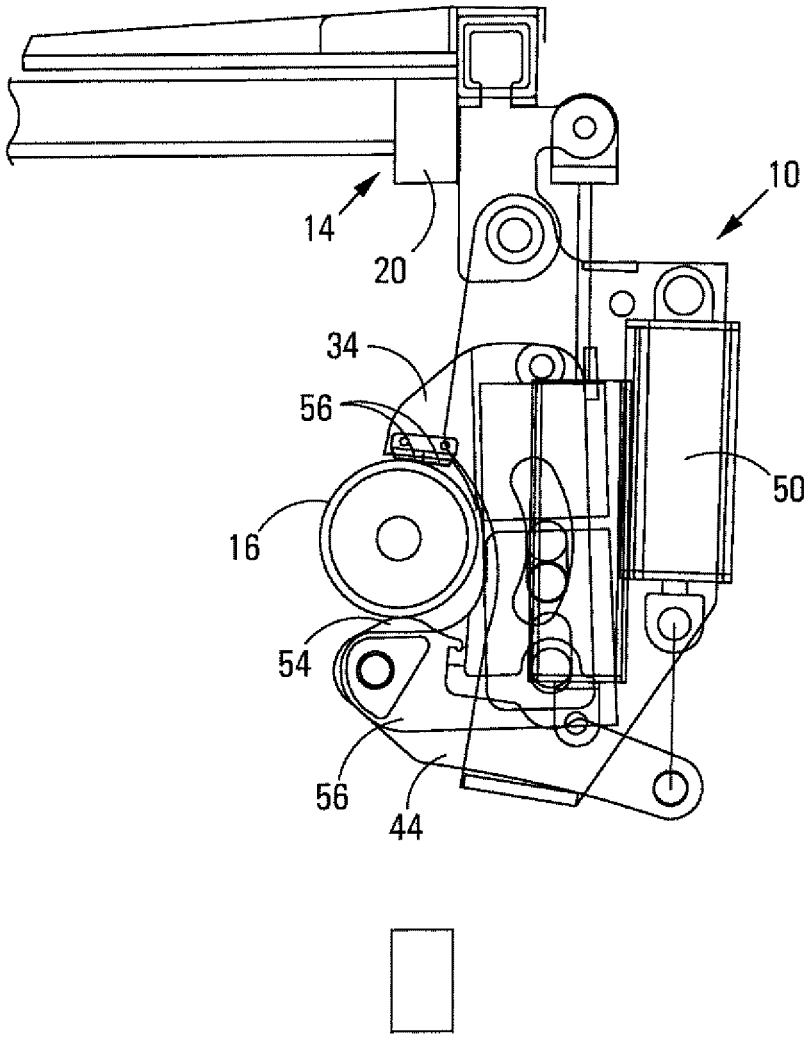

As the operation of the piston/cylinder mechanism 50 continues, it will act also on the pair of gripping members to provide for anticlockwise rotation of the gripping members about the longitudinal axis of the drill rod axis 16, actual loosening of the drill rod segment 16 with respect to its adjacent segment occurring particularly when the rotational force on the drill rod segment reaches a sufficient magnitude, while the gripping force on the drill rod segment still provides for a sufficient grip of the drill rod segment. It must be understood in this regard that for as long as rotation of the drill segment is resisted thereby, through the wedging action the magnitude of the gripping force on the drill rod segment will continue to increase, the rotational force acting on the drill rod segment simultaneously increasing until it is sufficient to permit loosening of the drill rod segment with respect to its adjacent segment, which has particularly occurred when the drill rod wrench reaches its configuration as shown in FIG. 9 of the drawings.

Figure 10:
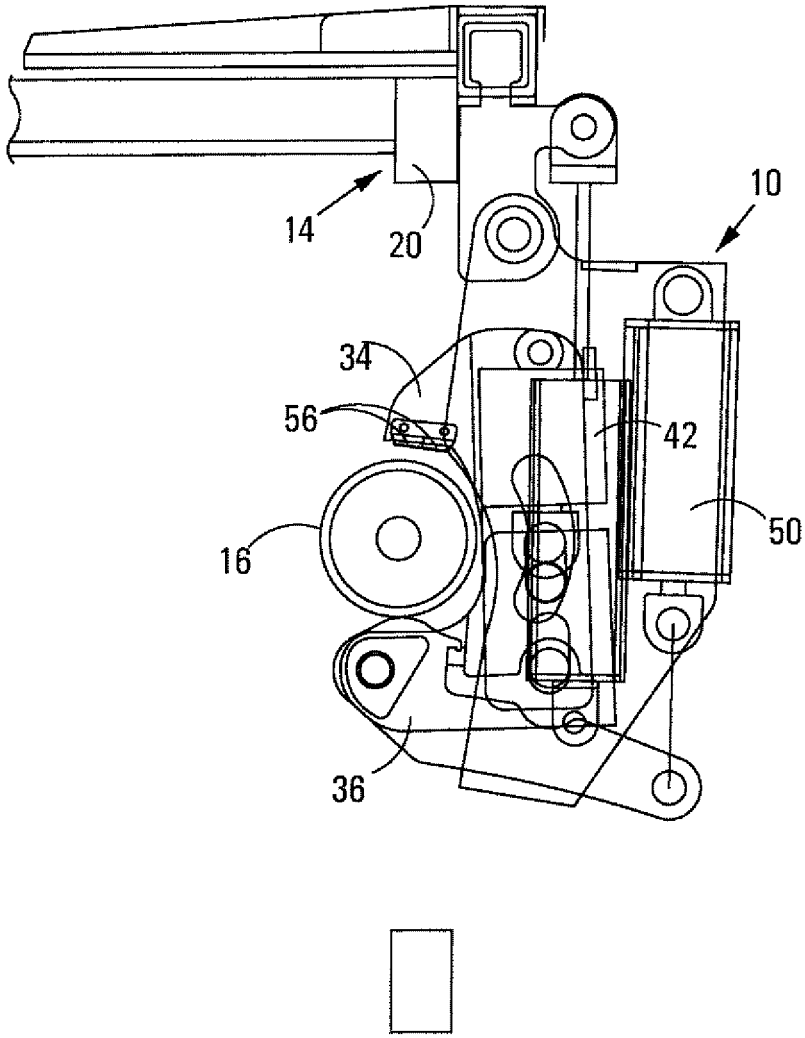
Figure 11:
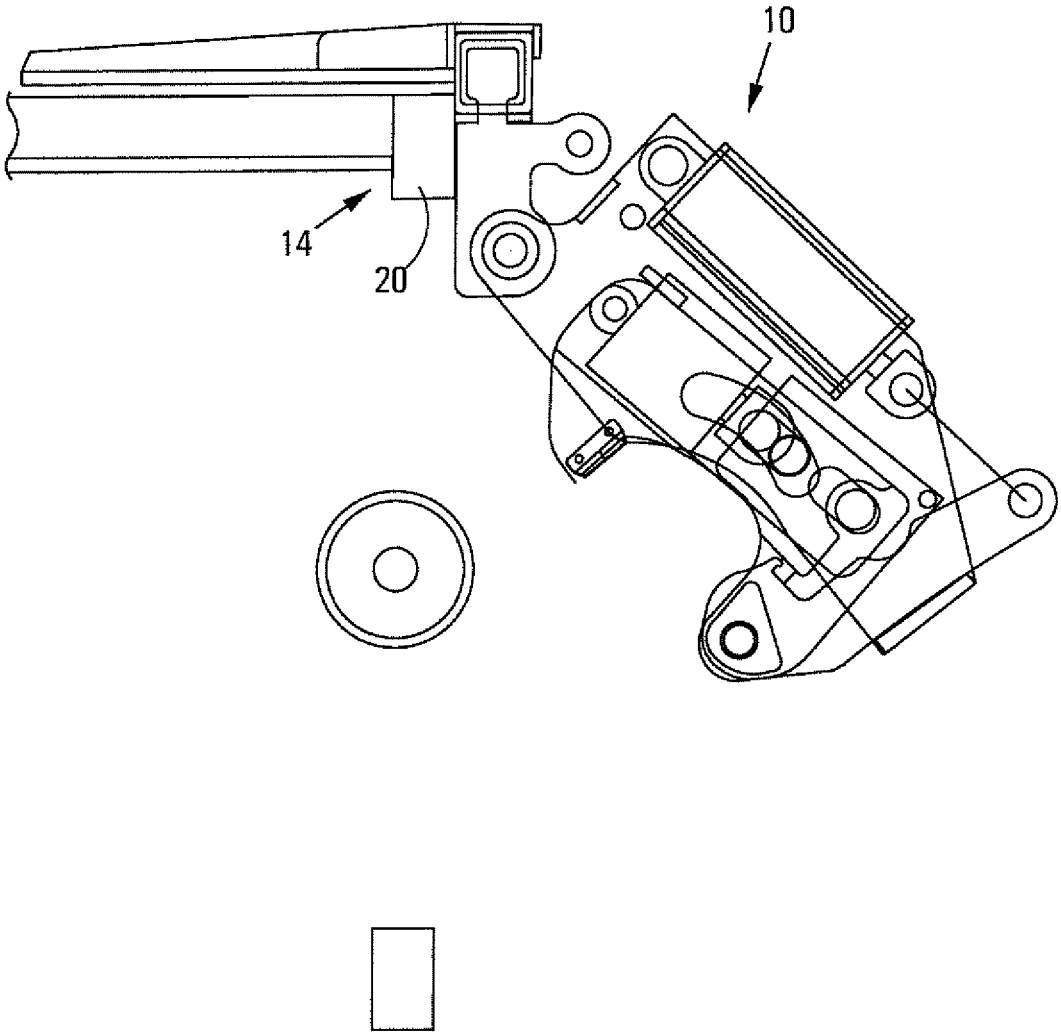
Figure 12:
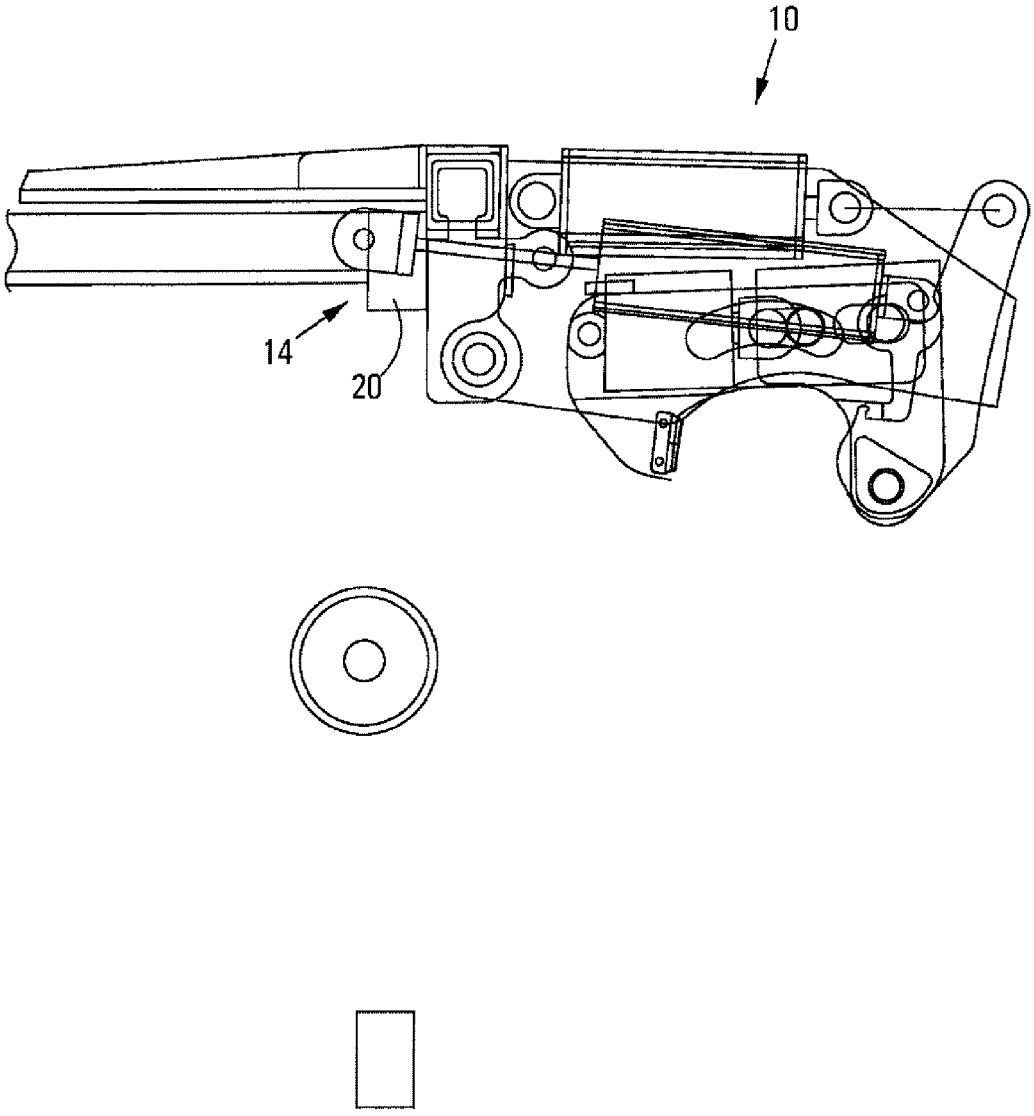

Following loosening of the drill rod segment 16, by the operation of the piston/cylinder mechanism 42, the gripping member 34 is linearly displaced with respect to the gripping member 36 to provide for separation of the gripping elements 56 from the drill rod segment 16, as shown in FIG. 10 of the drawings. Thereafter, and as shown in FIGS. 11 and 12 of the drawings, by the operation of the piston/cylinder mechanism 28 only shown in FIGS. 3 and 4, the pairs of carrier members and, as such, the drill rod wrench, are displaced from their operative configuration into their inoperative stowed-away configuration.

During a drilling operation, a further extension segment will then be located in line with the drill rod of the associated drilling apparatus, whereafter drilling can continue for an additional distance determined by the length of the extension segment, whereafter the operation of the drill rod wrench is repeated in order to provide for the insertion of a further extension segment in line with the drill rod. Clearly, following drilling of a hole, the process is effectively repeated except insofar as extension segments are then removed from a drill rod.

The configuration of the drill rod wrench of the invention as described above particularly is such that it can operate within a predetermined restricted space provided therefor by the associated drilling apparatus, which is particularly determined also by the configuration of the support structure of the drilling apparatus, and the mode in which the drilling part of the drilling apparatus is supported on this support structure.

It must be understood also that in a configuration in which the drill rod wrench 10 is mounted on the opposite side of the drill rod segment 16, i.e. on the support post 70 of the support structure 14 (see FIG. 3), the rotational displacement of the pair of gripping members with respect to the pair of carrier members and with respect to the drill rod segment can be suitably "modified" in order to accommodate this.

It must be appreciated also that the configuration of the drill rod wrench of the invention as described can be suitably varied in order to accommodate different space parameters within which it is to operate, while still utilising equivalent operating principles and general construction.

The invention claimed is:

1. A drill rod wrench for use on a drilling apparatus for loosening a drill rod segment of a drill rod, having a diameter falling within a predetermined diameter range, with respect to an adjacent drill rod segment of the drill rod, which includes, in its operative configuration with respect to a drilling apparatus having a support structure supporting the apparatus in a location where drilling is required, a pair of carrier members that are pivotally supported on the support structure of the drilling apparatus in a configuration in which the wrench is displaceable between an inoperative stowed-away configuration when drilling is permitted and an operative configuration in which the wrench is operable for loosening a drill rod segment;

a pair of engaged gripping members that are supported between the pair of carrier members and that, in combination, define an open mouth formation within which a drill rod segment, of a drill rod of the drilling apparatus, to be loosened with respect to an adjacent drill rod segment, is received when the carrier members are displaced into their operative configuration, the gripping members being displaceable between a first configuration in which the drill rod segment is freely received within the mouth formation and a second configuration in which it the drill rod segment is gripping members, one gripping member having a lever arm that defines a convex wedge formation, pivotally located thereon and the other gripping member having a gripping formation that is located substantially diametrically opposite the convex wedge formation when gripping the drill rod segment, pivotal displacement of the lever arm providing for displacement of the convex wedge formation with respect to the drill rod segment received within the mouth formation of the gripping members thereby enhancing gripping engagement of the drill rod segment by urging the drill rod segment into gripping engagement with the gripping formation located on the other gripping member the gripping members as a combination being displaceably located between the pair of carrier members in a configuration in which they are displaceable for rotation about a longitudinal axis defined by a drill rod segment gripped between the gripping members; and displacement mechanisms providing for displacement of the gripping members and the lever arm for gripping and loosening of the drill rod segment with resect to an adjacent drill rod segment, the displacement mechanisms including:

a) at least one first piston/cylinder mechanism that is operatively connected between the support structure of the drilling apparatus and one of the carrier members and that is hydraulically-operable for displacing the carrier members between their inoperative and operative configurations;

b) a second piston/cylinder mechanism operatively connected between the gripping members and that is hydraulically-operable for displacing the gripping members between their first configuration and their second configuration;

c) a third piston/cylinder mechanism operatively connected between the pair of carrier members and the lever arm to provide for pivotal displacement of the lever arm thereby to provide initially for enhanced gripping engagement of the drill rod segment between the convex wedge formation of the lever arm and the gripping formation located on said other gripping member, and thereafter for rotational displacement of the pair of gripping members, in combination, about the longitudinal axis of the drill rod segment gripped by the gripping members, to provide for loosening of the drill rod segment with respect to an adjacent drill rod segment, the gripping force induced by the lever arm increasing as the wedging action of the convex wedge formation continues, until loosening of the drill rod segment occurs.

2. A drill rod wrench as claimed in claim 1, in which the gripping members of the pair of engaged gripping members are engaged by pin formations provided on one gripping member that are slidably located within slot formations defined in the other gripping member, in a configuration in which they are linearly displaceable with respect to one another for permitting displacement of the gripping members between their first and second configurations.

3. A drill rod wrench as claimed in claim 2, wherein at least one of the gripping members has a pair of locating pin formations and the carrier members define arcuate slots within which the locating pin formations are received thereby to accommodate the required rotational displacement of the pair of gripping members, in combination, relative to the carrier members under the action of the third piston/cylinder mechanism.

4. A drill rod wrench as claimed in claim 1, wherein at least one of the gripping members has a pair of locating pin formations and the carrier members define arcuate slots within which the locating pin formations are received thereby to accommodate the required rotational displacement of the pair of gripping members, in combination, relative to the carrier members under the action of the third piston/cylinder mechanism.

* * * * *